US009341409B1

(12) United States Patent
Akers

(10) Patent No.: US 9,341,409 B1
(45) Date of Patent: May 17, 2016

(54) COMPACT PORTABLE DRYER FOR DAMP OUTDOOR GEAR

(71) Applicant: John E. Akers, Walnut Shade, MO (US)

(72) Inventor: John E. Akers, Walnut Shade, MO (US)

( * ) Notice: Subject to any disclaimer, the term of this patent is extended or adjusted under 35 U.S.C. 154(b) by 42 days.

(21) Appl. No.: 14/148,633

(22) Filed: Jan. 6, 2014

Related U.S. Application Data

(63) Continuation-in-part of application No. 13/969,937, filed on Aug. 19, 2013, now abandoned.

(60) Provisional application No. 61/743,038, filed on Aug. 24, 2012.

(51) Int. Cl.
*F26B 19/00* (2006.01)
*F26B 9/00* (2006.01)

(52) U.S. Cl.
CPC ..... *F26B 9/003* (2013.01)

(58) Field of Classification Search
CPC ..... F26B 5/00; F26B 7/00; F26B 19/00; F26B 21/00; D01D 53/00; D01D 53/04; A01B 12/00; A01B 12/06
USPC ..... 34/61, 80, 381, 95; 68/6; 220/521; 96/147
See application file for complete search history.

(56) References Cited

U.S. PATENT DOCUMENTS

| | | | | | |
|---|---|---|---|---|---|
| 954,840 | A * | 4/1910 | Wiedemann | 294/141 |
| 2,534,831 | A | 12/1950 | Polan | 68/6 |
| 4,967,986 | A * | 11/1990 | Schildkraut | 224/250 |
| 5,143,773 | A | 9/1992 | Takuno | 428/137 |
| D366,958 | S * | 2/1996 | Harr | D3/259 |
| 5,555,648 | A * | 9/1996 | Griffin | 34/621 |
| 5,625,960 | A | 5/1997 | Fujita | 34/80 |
| 5,729,909 | A * | 3/1998 | Chesnutt Robison | 34/109 |
| 5,887,358 | A * | 3/1999 | Bischel et al. | 34/115 |
| 5,907,908 | A | 6/1999 | Cunanan et al. | 34/61 |
| 5,917,110 | A | 6/1999 | Kust | 71/27 |
| 6,044,575 | A * | 4/2000 | Marschke | 34/124 |
| 6,217,701 | B1 | 4/2001 | Shelley et al. | 156/308.4 |
| 6,314,659 | B1 * | 11/2001 | Parker | 34/414 |
| 6,767,521 | B1 | 7/2004 | Vogt et al. | 422/306 |
| 7,087,566 | B2 | 8/2006 | Shireman | 510/212 |
| 7,171,707 | B2 * | 2/2007 | Landay | 5/413 R |
| 7,615,269 | B2 | 11/2009 | Payne et al. | 428/35.2 |
| 7,699,913 | B2 | 4/2010 | Grieve et al. | 96/147 |
| 7,770,305 | B1 * | 8/2010 | Krauss | 34/60 |
| 8,394,751 | B2 | 3/2013 | Hawes, III et al. | 510/365 |
| 8,506,675 | B2 | 8/2013 | Ellsworth | 95/10 |
| 8,935,858 | B2 * | 1/2015 | Cloutier et al. | 34/105 |
| 2006/0000837 | A1 | 1/2006 | Watson et al. | 220/521 |
| 2009/0071028 | A1 * | 3/2009 | G dke et al. | 34/108 |
| 2010/0205822 | A1 * | 8/2010 | Munden | 34/437 |
| 2011/0233810 | A1 | 9/2011 | Neigel et al. | 264/83 |
| 2013/0045252 | A1 | 2/2013 | Rawlings et al. | 424/400 |

* cited by examiner

*Primary Examiner* — Stephen M Gravini
(74) *Attorney, Agent, or Firm* — Jonathan A. Bay

(57) ABSTRACT

A compact portable dryer for damp outdoor gear has a tubular sleeve, an interspacing panel of reticulated foam, a ventilating plug and an air blowing plug. The tubular sleeve is a rectangle of canvas. It has strips of closures along both long edges, and both short edges. The closures along the long edges mate with each other in order to form the sleeve into a tube. The panel of reticulated foam is also a rectangle. It has a length between one pair of spaced edges that corresponds to the length of the tubular sleeve. Its thickness as well as length between the other pair of spaced edges are such that, when rolled into a cylindrical coil, the cylindrical coil has a diameter corresponding to the diameter of the tubular sleeve. The sleeve is plugged with the ventilating plug at one end and the air blowing plug at the other.

19 Claims, 11 Drawing Sheets

COMPACT PORTABLE DRYER FOR DAMP OUTDOOR GEAR

CROSS-REFERENCE TO RELATED APPLICATION(S)

This application is a continuation-in-part of U.S. patent application Ser. No. 13/969,937, filed Aug. 19, 2013, which claims the benefit of U.S. Provisional Application No. 61/743,038, filed Aug. 24, 2012. The foregoing patent disclosures are incorporated herein by this reference thereto.

BACKGROUND AND SUMMARY OF THE INVENTION

The invention relates to camping gear and, more particularly, to carry packs or stuff sacks provided with desiccant provisions in order to dry damp camping gear while packed therein.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings, FIG. 1 a perspective view of a desiccant provision in accordance with the invention for drying damp camping gear.

DETAILED DESCRIPTION OF THE PREFERRED EMBODIMENTS

Figure 1:
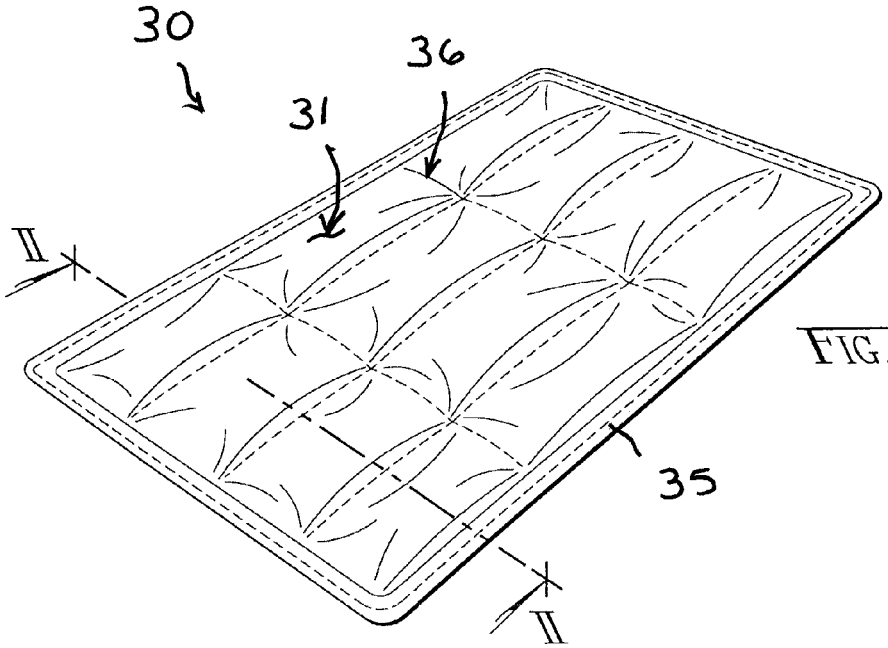
Figure 2:
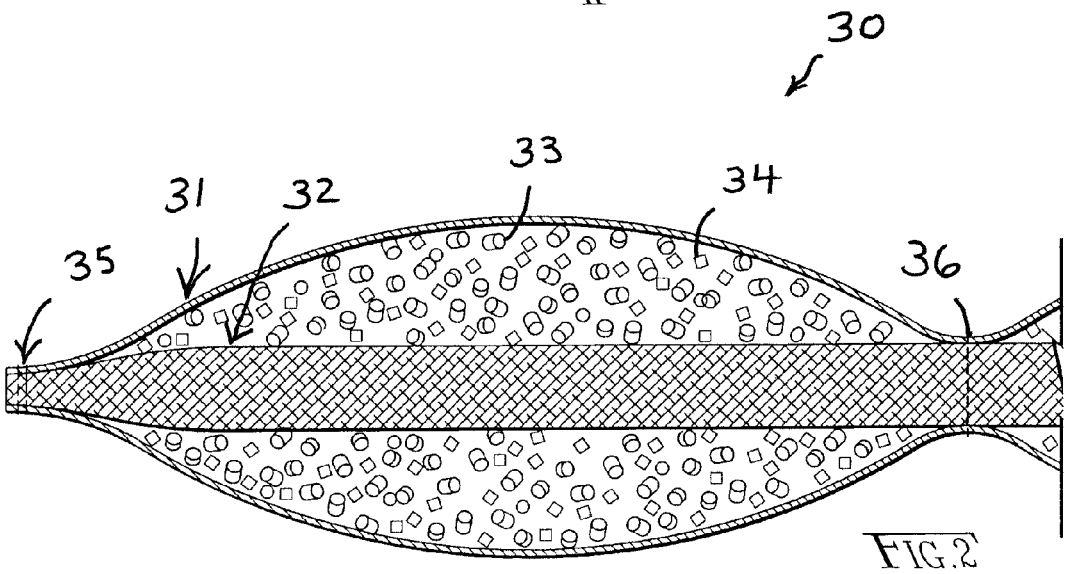
FIG. 2 is an enlarged-scale section view taken along line II-II in FIG. 1.
Figure 3:
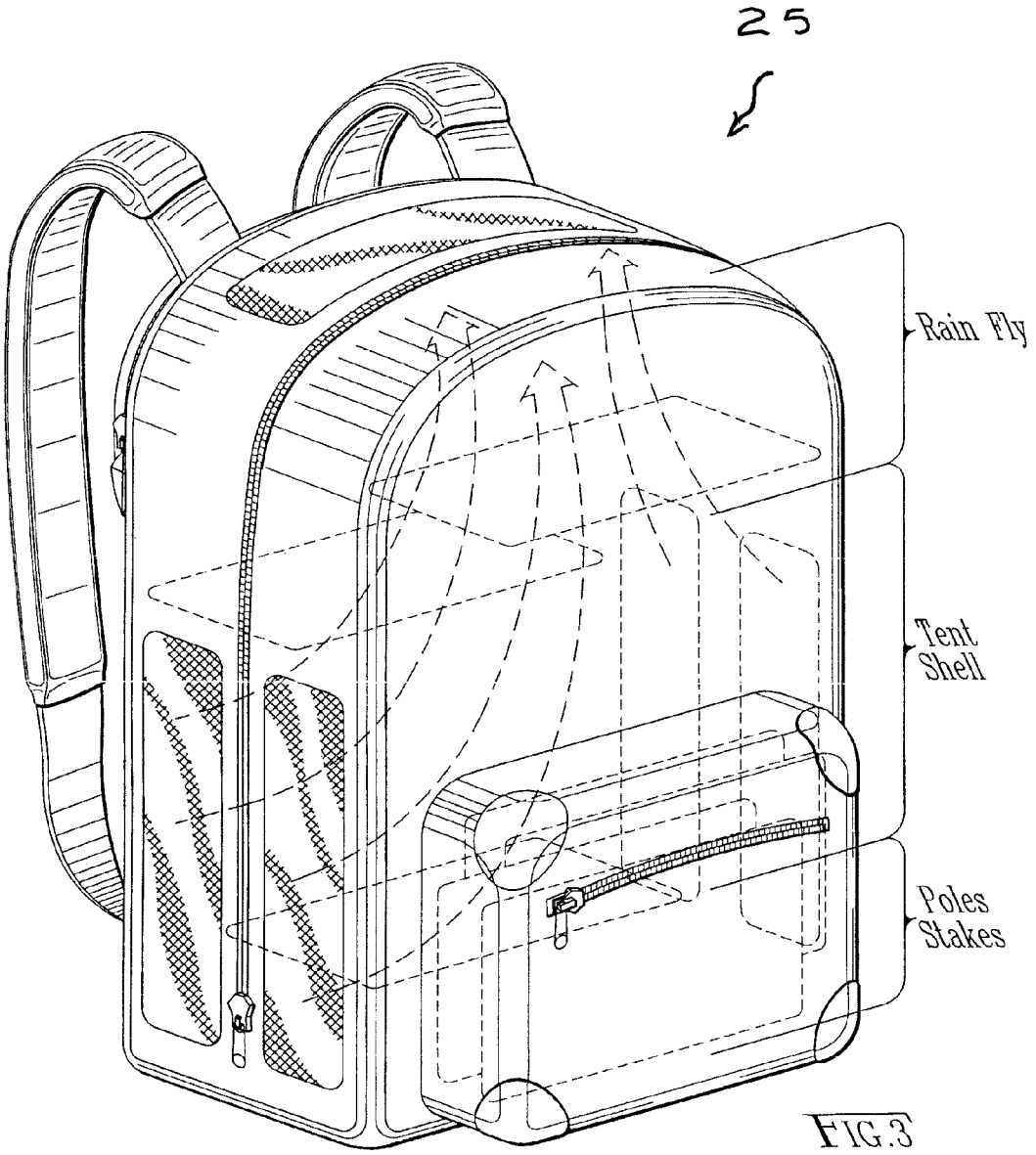
FIG. 3 is a perspective view of a carry-pack or stuff-sack in accordance with the invention provided with the desiccant provision of FIG. 1 for drying damp camping gear while packed therein.
Figure 4:
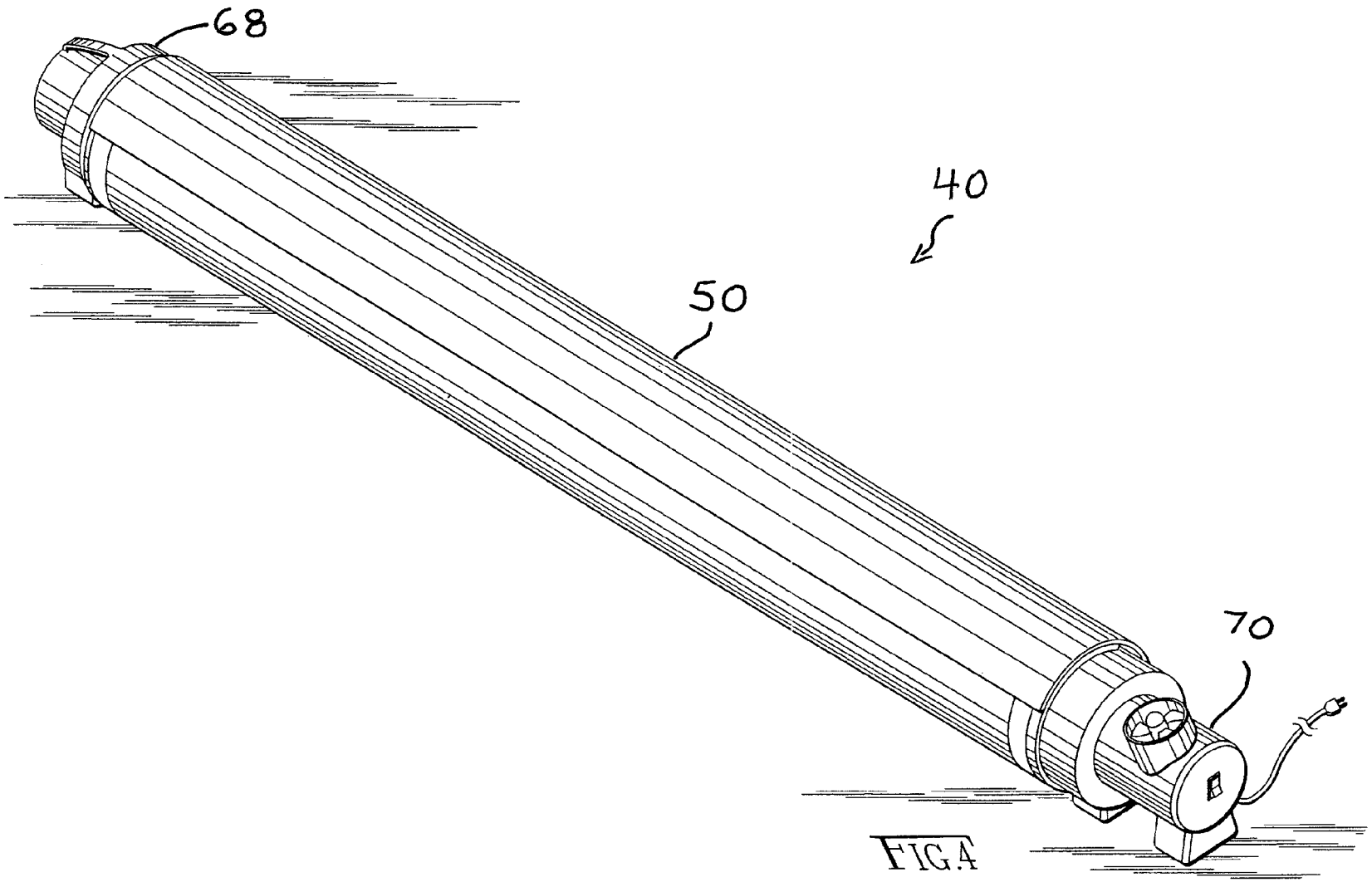
FIG. 4 is a perspective view of an alternate embodiment of the invention, comprising a compact portable dryer for damp outdoor gear.

FIG. 3 shows a non-limiting example of a carry pack 25 in accordance with the invention provided with a desiccant provision 30 in accordance with the invention, and as shown better by FIGS. 1 and 2, for drying damp camping gear while packed therein.

Examples of damp camping gear not only includes fabric-constructed items like tent shell and rain fly of a portable tent, but also simply the clothing worn by the camper.

The carry pack 25 can be configured as a ruck sack, or a fanny pack, and so on, without limitation. It is an alternate aspect of the invention that the advantages provided by the inventive desiccant provision can be put to use in a stuff sack construction in accordance with the invention (not shown), which stuff sack can then be packed in a conventional backpack or the like.

The desiccant-provisioned carry pack 25 in accordance with the invention is particularly advantageous for campers who break down their portable tents in the morning. Perhaps not only the rain fly but also the tent shell too might be soaked at this point from dew or rain. It is an aspect of the invention that packing the damp tent shell and rain fly into the carry pack 25 dries the damp tent fabrics sufficiently to eliminate damage from mildew or rot and the like. That way, the campers can get underway and vacate their campsite as soon as they like in the morning, and without having to wait around for the day to get old enough for the sun to dry the tent.

FIGS. 1 and 2 show better a non-limiting example of a desiccant provision 30. The desiccant provision 30 comprises a Drying Agent 33,34 and Wicking Elements 32. The desiccant pad 30 is placed in intimate contact with the camping gear to be dried (eg., tent fabrics, clothing) inside the carry pack. In FIG. 3, the carry pack 25 is optionally rigid or flexible (ie., hard-sided or soft-sided). The carry pack 25 has sidewalls that form at least one substantially vapor impermeable compartment in which the desiccant pad 30 and damp fabrics are packed in intimate contact.

The Drying Agent preferably comprises a mixture of a Sorbent 33 and an Absorbent 34 meeting the six criteria below:

1—The Sorbent 33 is an inorganic solid mixture and or compound exhibiting low human toxicity with a strong affinity for moisture. It attracts and sequesters relatively large amounts of water from the surrounding environment if allowed. The Sorbent 33 granules may be sized and or coated with no more than 3% by weight organic and or inorganic materials to slow their rate of moisture uptake.

2—In a closed air (assumed to be initially at 50% relative humidity) environment and when present in excess the Sorbent 33 will reduce to and maintain the absolute humidity between 0.14 to 5 milligrams of water per liter of air at 25° C. An example of an acceptable Sorbent 33 is granular anhydrous Magnesium Sulfate.

3—The Sorbent 33 does not exhibit dissolution in its water of hydration, melting or generation of liquid of more than 40% of it mass when containing 40% water and held at 50° C.

4—The Sorbent 33 will absorb not less than 29 grams of water per 100 grams of sorbent when immersed in air at 50% relative humidity and at 25° C. for 48 hours.

5—The Drying Agent may contain as much as 40% of the sorbent's mass of an Absorbent 34 to immobilize liquid due to deliquescence. An example of an acceptable Absorbent 34 is cellulose fiber. The Absorbent 34 may be treated with an anti-microbial/anti-fungal agent such as Reputex™ 20 and or a non-aqueous volatile fragrant material(s).

6—An Absorbent 34 will be able to immobilize more than two times its mass of saturated magnesium sulfate solution.

The Wicking Element 32 in accordance with the invention is a sheet of material that distributes excess aqueous solutions that result from deliquescence over the entire desiccant pad by capillary action. The Wicking Element 32 is synthetic non-woven, woven or knitted textiles that exhibit excellent wicking properties. An example of an acceptable Wicking Element 2 is COOLMAX® a product of E. I. DuPont de Nemours & Co. Other acceptable wicking element include various foams.

The desiccant pad 30 is fabricated of two sides of Sheathing 31 (flexible sheet material that allows water vapor to pass through, but resists the passage of liquid water) and filled with the Wicking Element(s) 32, Sorbent 33 and Absorbent 34. The desiccant pad 30 is sealed around its perimeter with not less than a twelve millimeter inch border 35. This can be done any by heat sealing, application of an adhesive(s)/coating(s), ultrasonic welding and or sewing. The desiccant pad 30 may have points where the Sheathing 31 and the Wicking Element(s) 32 are directly joined using any of the methods above other than the ones on its perimeter, which are called Stitch Points or Seams 36. Stitch Seams 66 help to maintain the desiccant pad 30's dimensions. The desiccant pad 30's dimensions and loading of Wicking Element(s) 32, Sorbent 33 and Absorbent 34 are generally proportioned in accordance to the fabrics meant to be dried. Examples of the acceptable Sheathing 31 are 1059B TYVEK®, a product of E. I. DuPont de Nemours & Co., and/or polyethylene coated polyester.

The carry pack 25 of FIG. 3 comprises at least one compartment that is not less than 5% more voluminous than the manufacturer's dedicated reusable container for the same fabric article(s) if one exists. The carry pack can be hard-sided (and hence rigid) or soft-sided (and hence flexible). Regardless, preferably the carry pack 25 comprises walls (define the compartments) which are substantially vapor impermeable.

It is a preference for the desiccant-provisioned carry pack 25 in accordance with the invention that the desiccant pad of the present invention comprises a mixture of about 90% by mass granular Anhydrous Magnesium Sulfate and about 10% by mass cellulose fiber treated with Reputex™ 20 and Cedarwood Oil surrounding a COOLMAX® Wicking Element all Sheathed in heat sealed 1059B TYVEK® (with a small amount of polyethylene added to improve the heat seal).

In use, the desiccant-provisioned carry pack 25 in accordance with the invention provides the following advantages to campers camping in portable tents. The inevitably have to deal with the problem of moisture in or on their tents, and perhaps some of their clothing too, and so on. The desire to remove this moisture can range from the desires of weekend campers to the desires of extreme wilderness campers in harsh climates.

In the case weekend campers, most people do not want to be bothered having to wait around in the morning and drying their tent in the sun. Even then, moisture is often trapped in the folds of the tent causing the growth of mold and odor. Most tent owners simply fold the tent up to the best of their ability and rarely does their tent fit back into the original stuff sack the tent was sold in. Upon unrolling the tent for use on the next camping trip, the tent inevitably will have a damp, musty smell.

By utilizing this desiccant-provisioned carry pack 25 in accordance with the invention, the camper can substantially mitigate or eliminate the problem of moisture and the odors resulting from trapped moisture. Once campers remove personal items from the tent, they simply remove the desiccant pad 30 described in this application from its barrier bag packaging (not shown), unfold it onto the floor of the tent, then fold the tent up with the desiccant pad 30 inside. They then can stow the tent in an easy to carry, substantially vapor impermeable carry pack 25, which is more spacious than the original stuff sack the tent was sold in. Upon the next use, the tent will be dry and less odiferous than had the moisture stayed trapped within the tent fabric. In addition, the used desiccant pads 30 can be shredded, rinsed and recycled.

In the above example, the desiccant pad 30 of FIGS. 1 and 2 is placed in intimate contact with the tent fabrics and stowed therewith. The moisture entrained in the tent fabric is drawn out of the fabric by a difference in water vapor pressure generated by the Sorbent 33 in the desiccant pad 30 while stowed. The generated water vapor travels to the desiccant pad 30 and passes through the Sheathing 31. Once passed through the Sheathing 31, the Sorbent 33 then sequesters the moisture. If localized deliquescence occurs, the generated solution is distributed throughout the desiccant pad 30 by the Wicking Element(s) 32 to be sequestered by Sorbent 33 or absorbed by the Absorbent 34. When the camper stows the tent and desiccant pad in the carry pack 25 (FIG. 3), this reduces the amount of moisture the desiccant pad 30 draws from sources other than the fabrics to be dried and make it easier to stow the tent because of the carry pack's spacious and ergonomic nature.

In the case of a more serious wilderness camping over extended time periods, wet clothing can be a danger. The desiccant provision(s) 30 and carry pack 25 combination in accordance with the invention can further be utilized to dry clothing and other damp, fabric articles.

It is an aspect of the invention to effectively distribute moisture due to deliquescence to be absorbed more efficiently in the desiccant pad 30.

In a further embodiment of the invention to incorporate vacuum drying. The external containers are preferably but non-exclusively rigid to semi-rigid and vapor impermeable. The containers would include connections for coupling to a vacuum hose. The articles to be dried would be inserted in the container with the desiccant pad(s) 30 and like chemicals. A partial vacuum would be applied via a vacuum cleaner or the like to augment the drying of the contained articles. Indeed, the applied vacuum might be the main means to effect drying. Some car vacuum cleaners are designed to run off 12 VDC and have a cigarette-lighter style jack.

FIGS. 4 through 14 show an alternate embodiment of the invention, in the manner of a compact portable dryer 40 for drying damp outdoor gear 42,44.

The compact portable dryer 40 in accordance with the invention is provided for drying primarily fabric articles. The inventive compact portable dryer 40 relies on a flexible continuous interspersed physical medium 48 that serves as a spacer between fabric layers 42 and 44, and facilitates forced air ventilation therethrough, even serving as channels for liquid water to drain out of the damp outdoor gear article, as well as allows gases and vapor to pass with little resistance also.

Desiccant provisions 30 can be used as a complimentary means to dry the damp article 42,44. The desiccant provisions 30 sequester water from the article 42,44 being dried.

The inventive compact portable dryer 40 can be used in concert with a flexible or ridged housing 50 that encloses the both the article 42,44 to be dried, the ventilation/spacer medium 48, and the desiccant provisions 30. The housing 50 would be used for the sake of controlling the flow of water as well as gasses and vapor as well as providing a convenient carrying case. One non-limiting example of such a housing 50 comprises a flat sheet of canvas that when rolled up forms a tube measuring about ten feet (~3 m) in length and one foot (~⅓rd m) in diameter. The tubular housing 50 will have a closable closure 52 along the whole longitudinal length thereof from nearly end to end, forming a longitudinal seam in the canvas tube. The seam 52 can be closed by closure devices such as zippers, snaps, hook and pile and so on. The canvas can be of synthetic or natural material, and coated too with waterproofing.

The inventive compact portable dryer 40 preferably relies on a flexible continuous interspersed physical medium 48 that spaces and ventilates inter-layers of the predominantly fabric article to be dried. Again, the spacing/ventilating medium 48 both forms channels for liquid water to drain out as well as allows forced-air ventilation of gases and vapor therethrough with little resistance. An example of (and without limitation) a flexible continuous interspersed physical medium for spacing and ventilating comprises without limitation Future Foam's thermally reticulated polyether foam R08E1550C.

Figure 11:
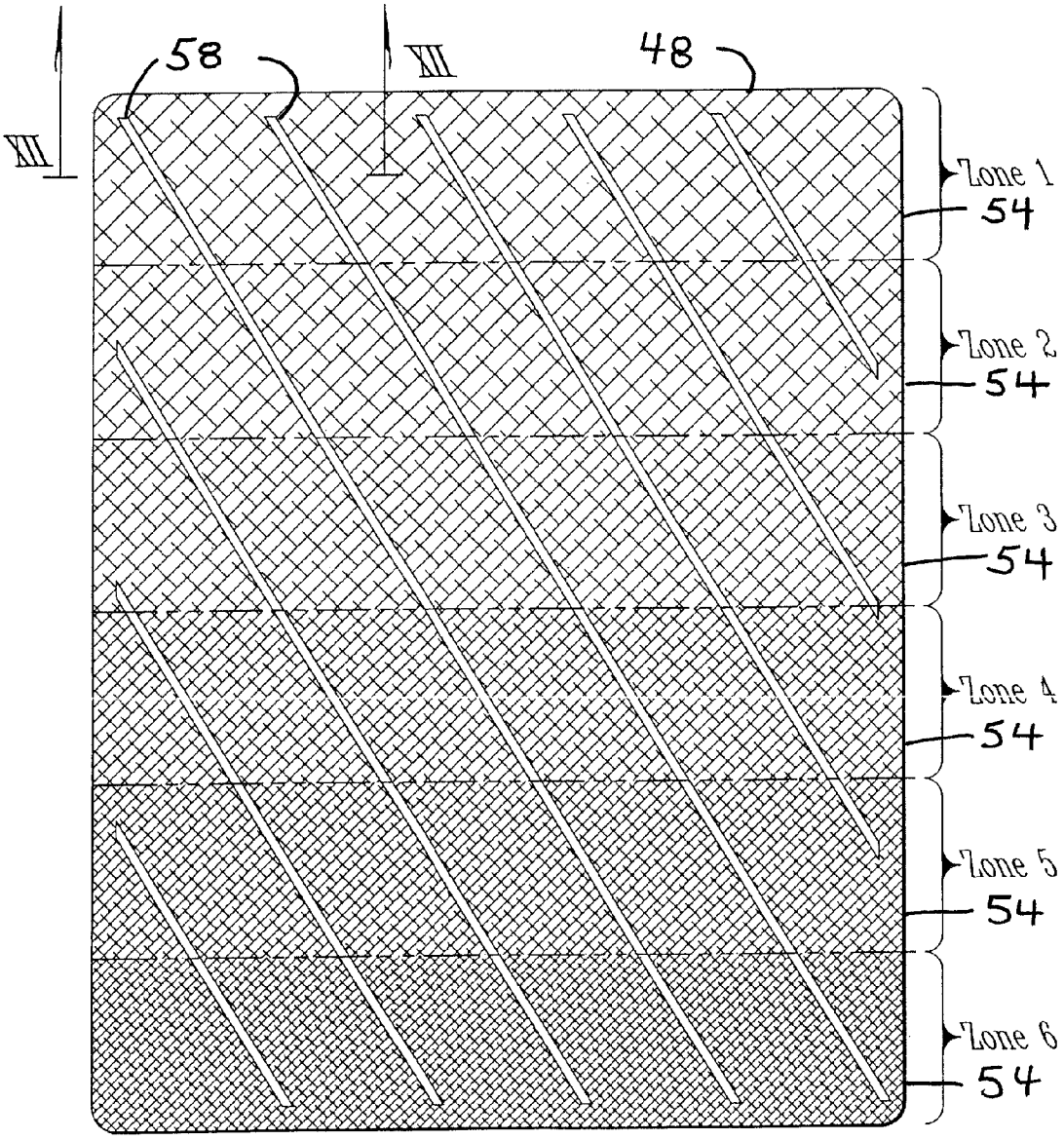
FIG. 11 is plan view of a panel of reticulated foam in accordance with the invention, showing striations into zones of progressively denser density (thus forcing the internal air flow laterally out through the opposite broad sides of the panel and into the rain fly and tent shell respectively) as well as will diagonal ribbons of flow partitions which, when the panel is rolled into a coil, will form spirals of flow barriers tending also to force the internal air flow laterally out through the opposite broad sides of the panel and into the rain fly and tent shell respectively.
Figure 12:
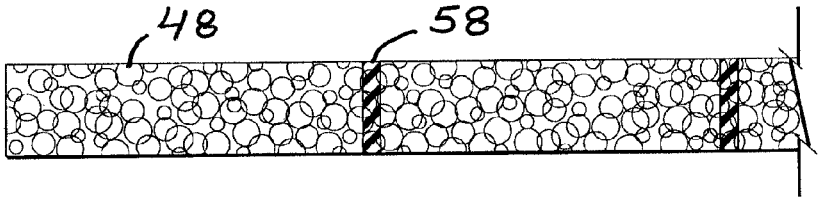
FIG. 12 is an enlarged scale section view taken through cutting line XII-XII in FIG. 11.

FIGS. 11 and 12 show a panel of reticulated foam 48 in accordance with the invention. Preferably this sheet of foam 48 is about ten feet (~3 m) long, six feet (~2 m) wide and an inch (2.54 cm) thick. This foam is very porous. It is perhaps 95% air, the rest a tangled, irregular lattice of polyether filament.

FIG. 11 furthermore shows that the foam panel 48 has striations or is divided into divisions or zones 54 of progressively denser density foam material. Thus an internal air flow forced (or blown) into the leading edge of the foam panel 48 with the least density will be relative unimpeded in the first zone 54 of (low) density. The internal air will become progressively more impeded by each incremental step up in density in each succeeding zone 54, thus forcing the internal air flow laterally out through the opposite broad sides of the panel 48 and into the rain fly 42 and tent 44 shell respectively.

FIGS. 11 and 12 moreover show that the foam panel 48 has diagonal ribbons 58 of flow partitions which, when the panel 48 is rolled into a coil, will form spirals of flow barriers tending also to force the internal air flow laterally out through the opposite broad sides of the panel 48 and into the rain fly 42 and tent shell 44 respectively. These ribbons 58 may be formed by dripping a line of rubber cement or the like diagonally across the foam panel 48. These ribbons 58 might also be infused with desiccant material.

The inventive compact portable dryer 40 can be used in concert with forced air passing through the medium/spacer to facilitate drying.

The inventive compact portable dryer 40 an be used in concert with encapsulated desiccants 33,34 to sequester water from the article 42,44 to be dried.

The inventive compact portable dryer 40 can be used in concert with desiccant provisions 30 that maintain a desired humidity range to sequester water from the article 42,44 being dried.

The inventive compact portable dryer 40 an be used in concert with Chemical or electrical heating means to volatilize moisture and facilitate drying.

The inventive compact portable dryer 40 can be used in concert with a volatile natural product that when applied to the medium/spacer 48 creates a pleasant odor and may repel insects.

The inventive compact portable dryer 40 can be used in concert with a flexible or ridged housing 50 that encloses the medium/spacer 48, the article(s) 42,44 to be dried, and/or any heating means as well as desiccants and so on. The housing 50 would be used for the sake of controlling the flow of water as well as gasses and vapor, and then also for serving as a convenient carrying case.

As said before, an example of a flexible continuous interspersed physical medium/spacer 48 includes Future Foam's thermally reticulated polyether foam R08E1550C.

Examples of encapsulated desiccants include without limitation what are disclosed by U.S. Pat. No. 6,217,701, the disclosure of which is incorporated herein by this reference thereto.

An example of a volatile natural product that when applied to the medium/spacer creates a pleasant odor and may repel insects included without limitation Cedar Oil.

FIGS. 5 through 10 comprise somewhat of a slideshow demonstrating a manner of use of the alternate embodiment of the invention, namely, the compact portable dryer 40 for damp outdoor gear.

Figure 5:
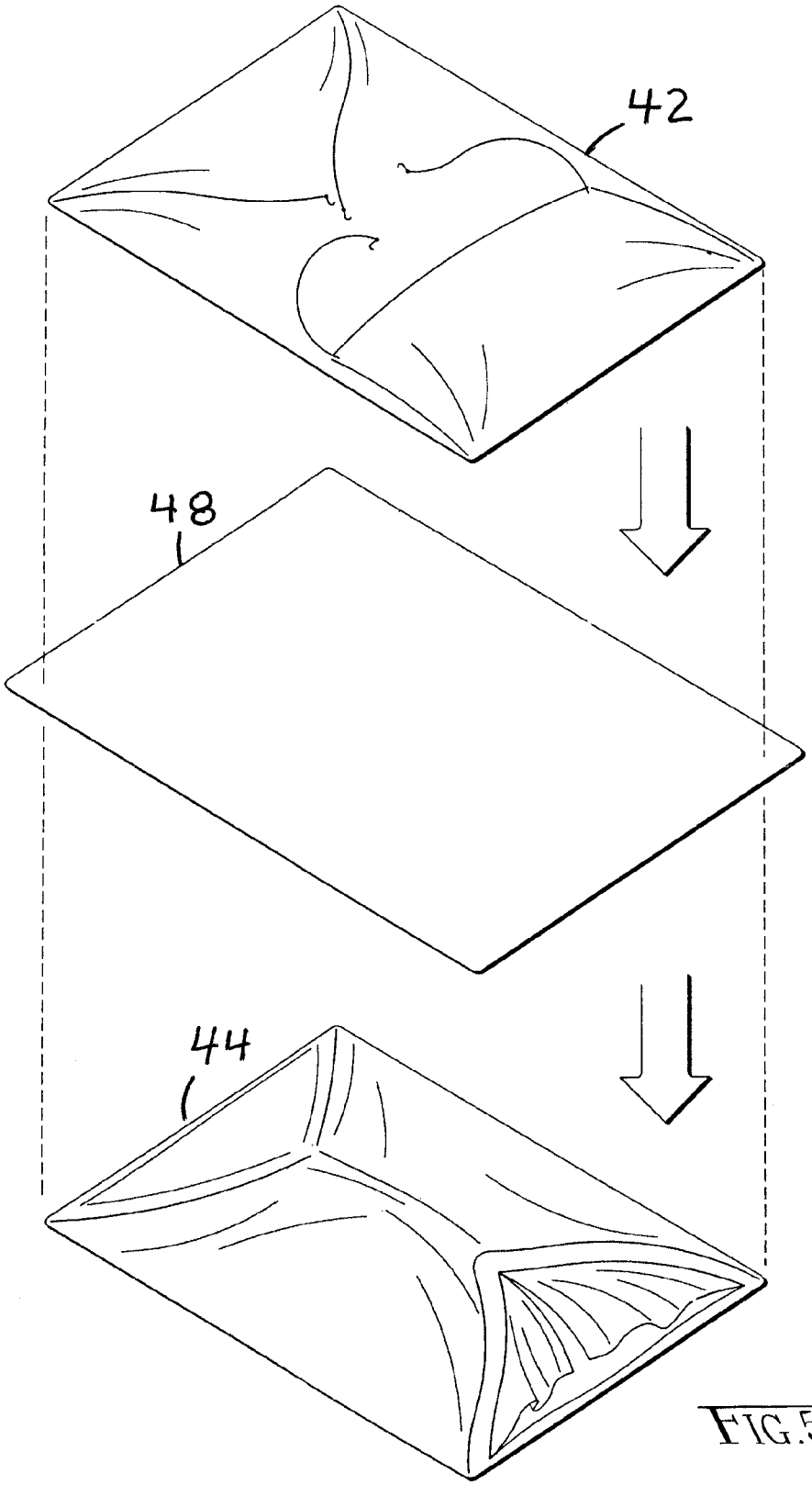
FIG. 5 is an exploded perspective view showing a panel of reticulated foam in accordance with the invention being sandwiched between an outspread rain fly and outspread tent shell (eg., both of which are presumptively damp)
Figure 6:
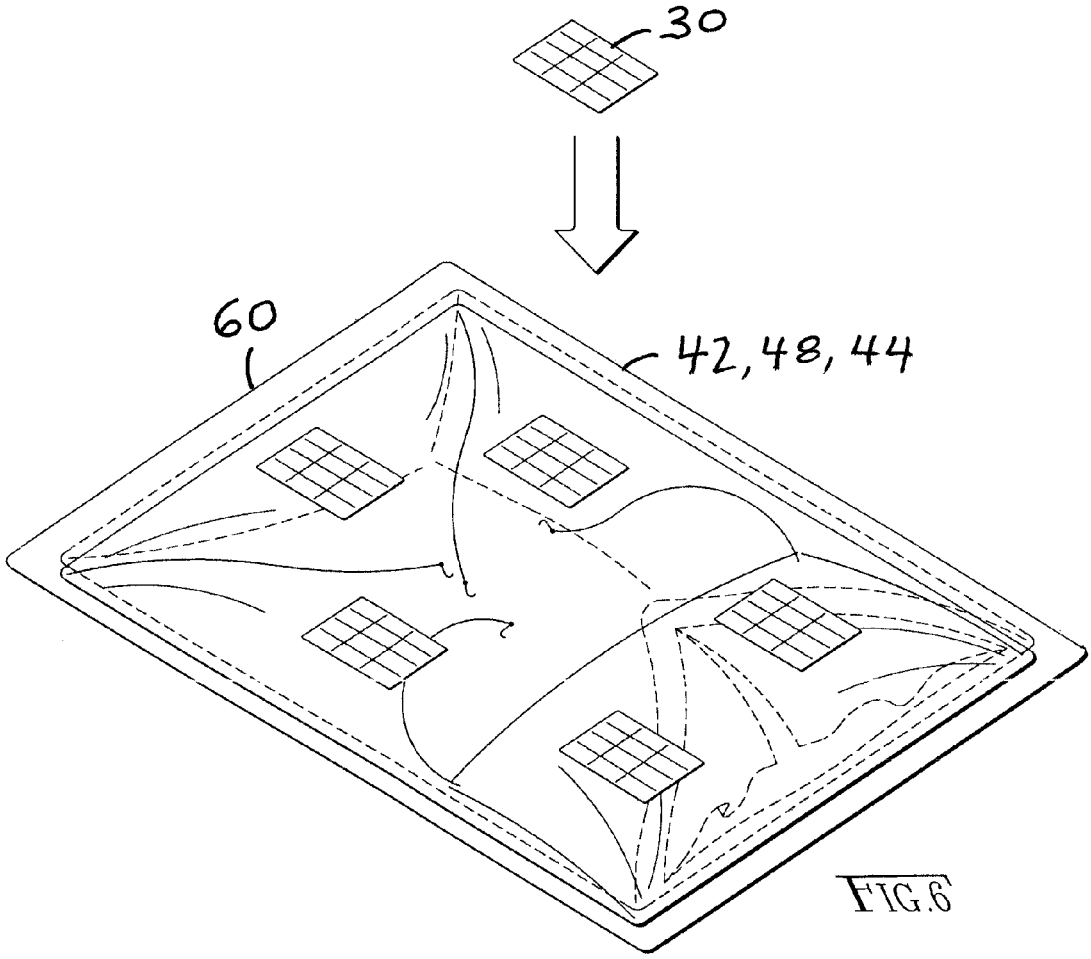
FIG. 6 is a perspective view comparable to FIG. 5, except showing the three layers of rain fly, foam panel and tent shell clapped together, and with packets of desiccant distributed around in the sandwich.

FIG. 5 is a shows a tent shell 44 spread out on the ground (eg., a garage floor). In FIG. 5, the foam panel 48 is shown suspended over the tent shell 44, and the rain fly 42 is shown suspended over the foam panel 48. The reticulated foam panel 48 is very porous. The reticulated foam panel 48 is also very low density. Moreover, reticulated foam panel 48 is fairly solid. Hence reticulated foam won't crush (and thereby close off its porosity) except under extreme pressures not likely to be obtained here by the two people (or so, and not shown) working together rolling the reticulated foam panel 48 into a coil.

In fact, it is supposed that the extreme pressures required to crush the reticulated foam panel 48 would be something like a car driving over the panel, and not a person walking over it. Preferably the panel 48 measures about ten feet (~3 m) long, six feet (~2 m) wide and an inch (2.54 cm) thick.

Figure 8:
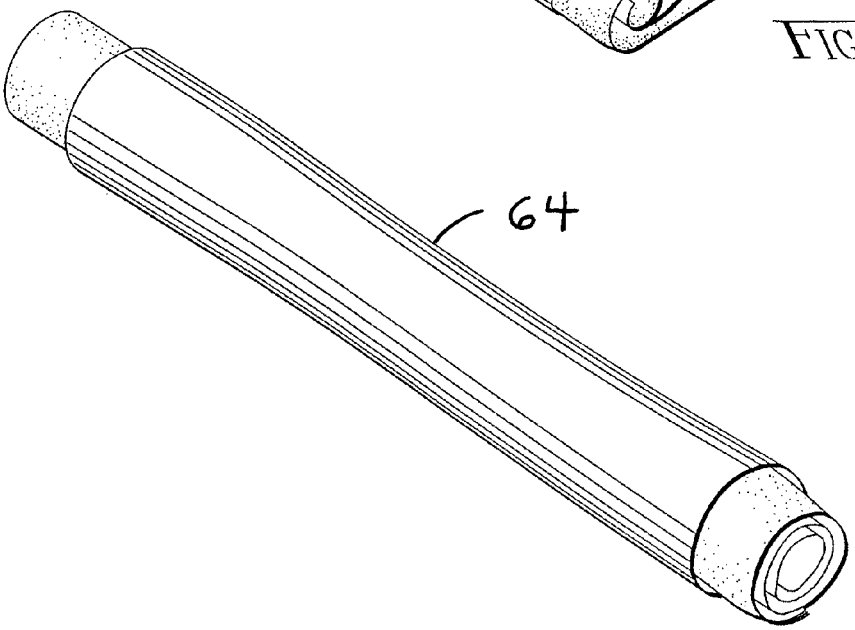
FIG. 8 is a perspective view comparable to FIG. 7, except showing the rolling of the tubular coil completed.

FIG. 8 shows the rain fly 42 lying on top of the panel 48 which lies on top of the tent shell 44, which all together form a sandwich (or layer structure 60) with the foam panel 48 in the middle. In contrast to using a single foam panel 48 that is about an inch (2.54 cm) thick, two foam panels 48 (this is not shown) can be used such that the layer structure 60 is built something like this: —a first layer of a foam panel 48, a second layer being one of the fly 42 or shell 44, then a third layer being a foam panel 48 again, with the final layer being the other of the fly 42 or shell 44 on top. In FIG. 8 preferably packets 30 of desiccant are spread over the surface of the layer structure 60 (which in FIG. 8, is the rain fly 42). Preferably the desiccants pads 30 are denser on the layer structure 60 at what will be the downstream half of the layer structure 60. Experience teaches that, the upstream half dries faster and needs less help from the desiccants.

Figure 7:
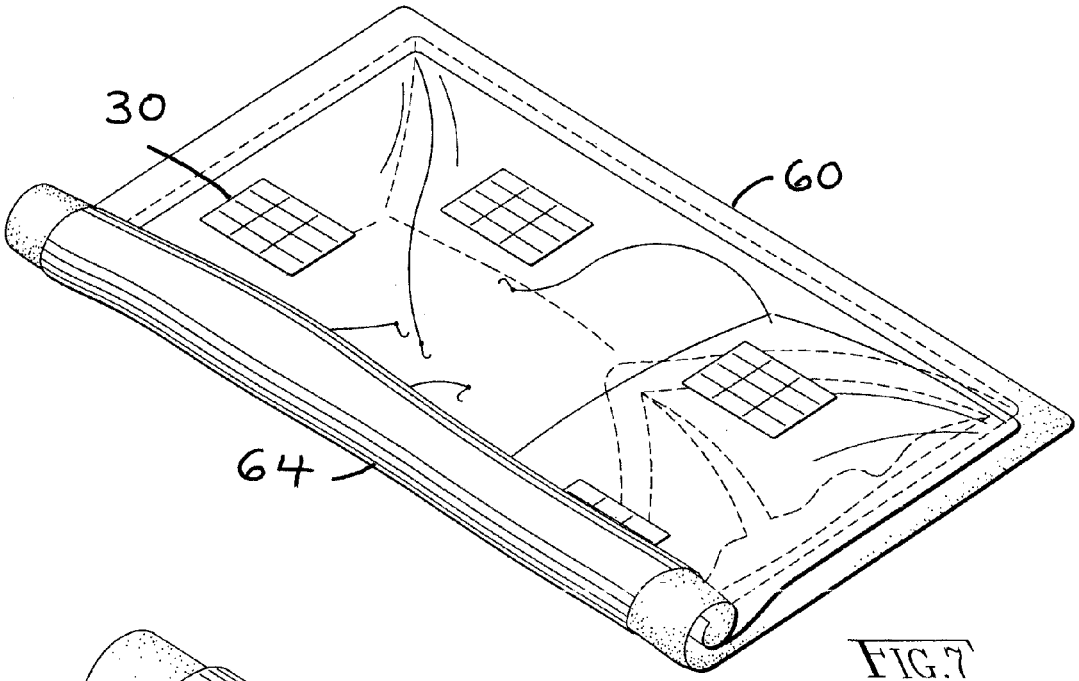
FIG. 7 is a perspective view comparable to FIG. 6, except showing the sandwich being rolled into a tubular coil.

FIGS. 7 and 8 show that the layer structure 60 is rolled into a roll 64. The packets 30 of desiccant are rolled into the roll 64 as well, as shown by FIG. 7.

Figure 9:
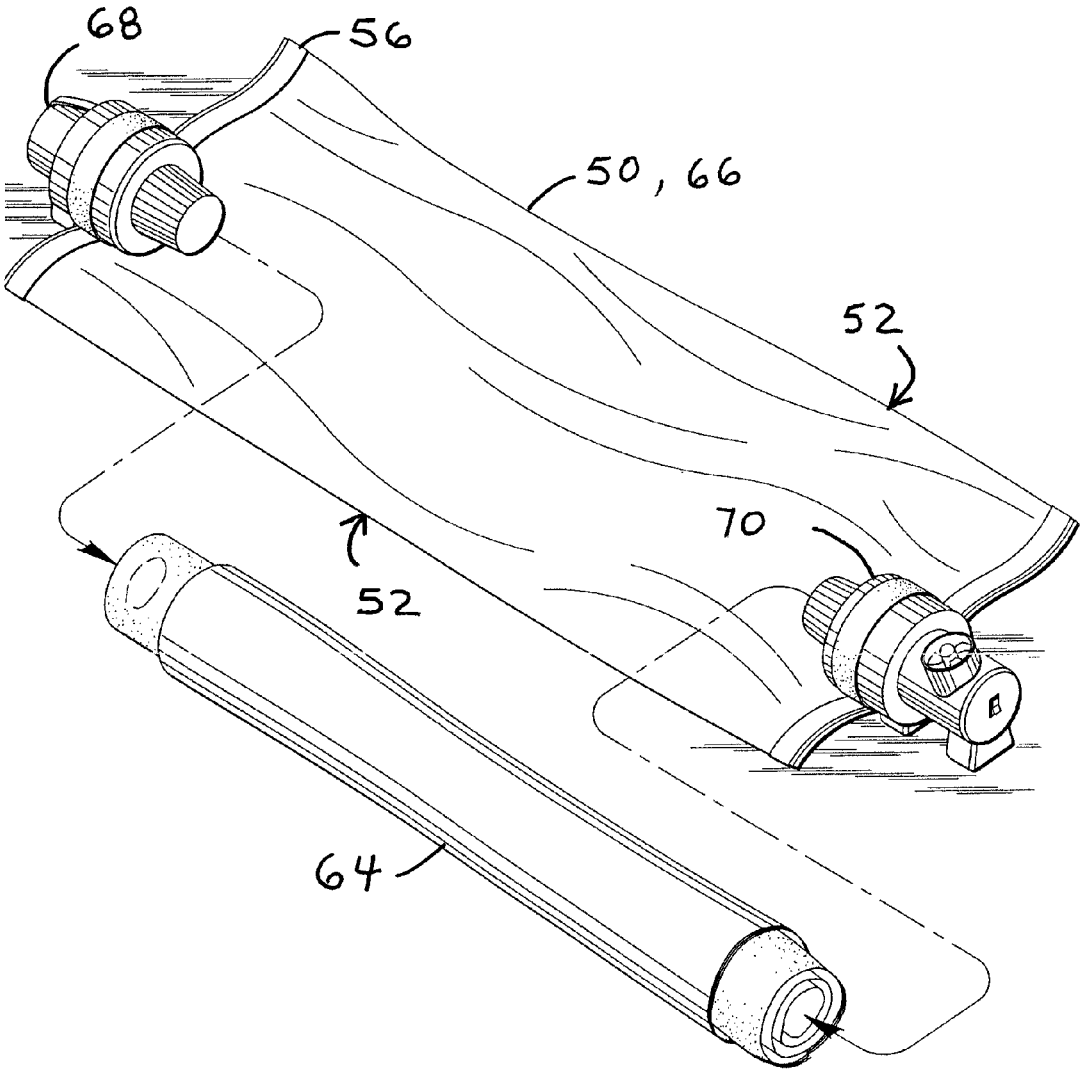
FIG. 9 is a perspective view comparable to FIG. 8, except showing the tubular coil being wrapped in an outer sleeve of the compact portable dryer of FIG. 4.
Figure 10:
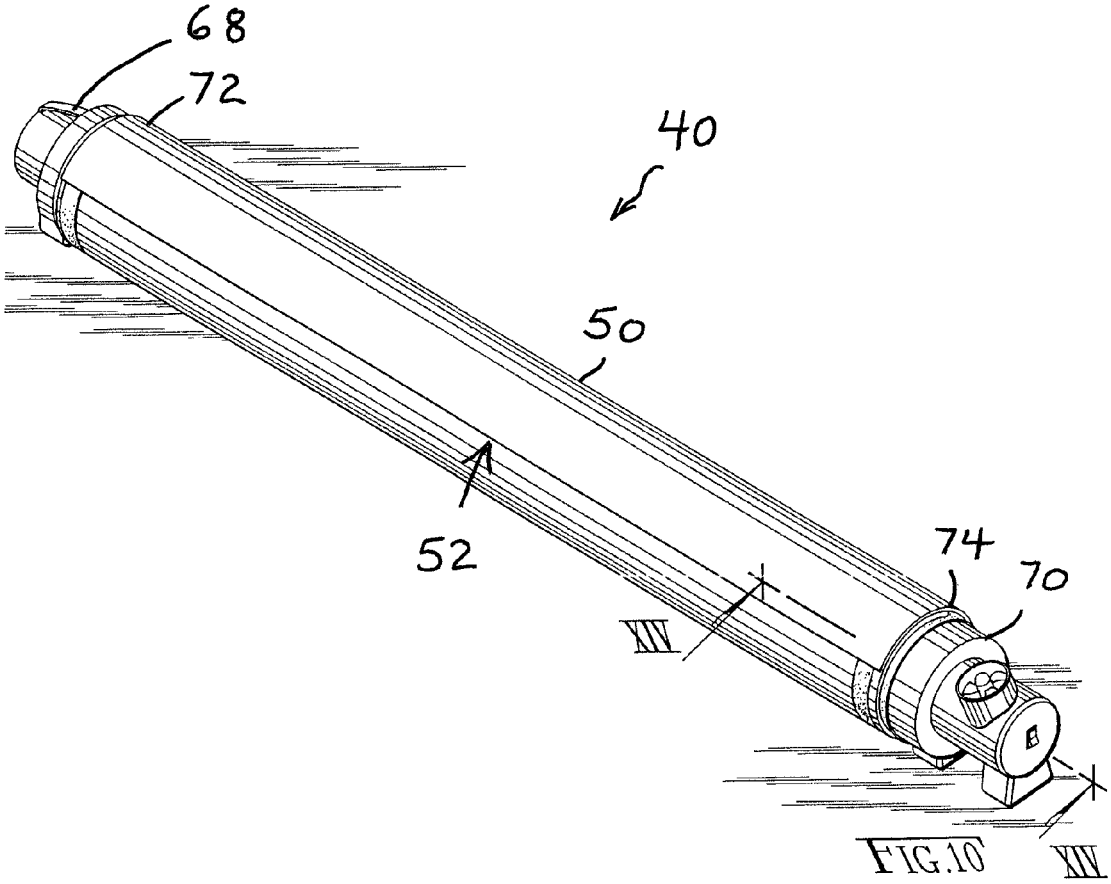
FIG. 10 is a perspective view comparable to FIG. 9, except showing completed assembly of the compact portable dryer.

FIGS. 9 and 10 show that the roll 64 gets wrapped and secured in the tubular sleeve 50 as shown.

The tubular sleeve 50 is preferably a flat piece of canvas or tarp 66 or the like measuring about ten feet (~3 m) in length and three feet (~1 m) in diameter. The flat canvas or tarp 66 preferably has hook or pile fastening strips 52 and 56 bordering all four edges. The hook or pile strips 52 along the two long edges are meant to latch to one another thereby to form the flat canvas or tarp 66 into the tubular sleeve 50. The hook or pile strips 56 along the two short edges are meant to latch onto respective plug closures 68 and 70 therefor, as described next. Alternatives to the hook and/or pile strips can include (and without limitation) zippers, buttons, snaps and so on.

With general reference to FIGS. 9-10 and 13-14, the tubular sleeve 50 is elongated between two ends 72 and 74 (needless to say). But one end can be reckoned as a downstream end 72 and the other end as the inlet end 74. Generally when the roll 64 is rolled, the users will know which end of the roll 64 will be placed at the inlet end 72. There will be some difference in the properties of the roll 64 that will make it preferable that one end of the roll 64 be placed at the inlet end of the tubular sleeve 50. Either the foam panel 48 will have a progressive density difference making one edge the preferred intake edge, or else the roll 64 will be peppered more densely with desiccant pads 30 on the downstream half, or the article to be dried 42,44 will be damper nearer the inlet end 74 or rolled tighter nearer the inlet end 74—just something will be the difference. Once the roll 64 is secured in the tubular sleeve 50, the sleeve 50's opposite ends 72 and 74 are essentially mirror counterparts to each other. However, again and because of the properties of the roll 64, one end of the tubular sleeve 50 is nominally a downstream end 72 and the other is the inlet end 74. Accordingly, the downstream end 72 of the tube 50 is closed or plugged with a plug assembly comprising a ventilating plug 68. Conversely, the inlet end 74 of the tubular sleeve 66 is plugged or closed by another plug assembly, except comprising an air blowing plug 70.

Both plug assemblies 68 and 70 are pretty similar, except for the big difference of an air blowing fan 76 for the air blowing plug 70 and just a big open exhaust port 78 for the ventilating plug 68.

Figure 14:
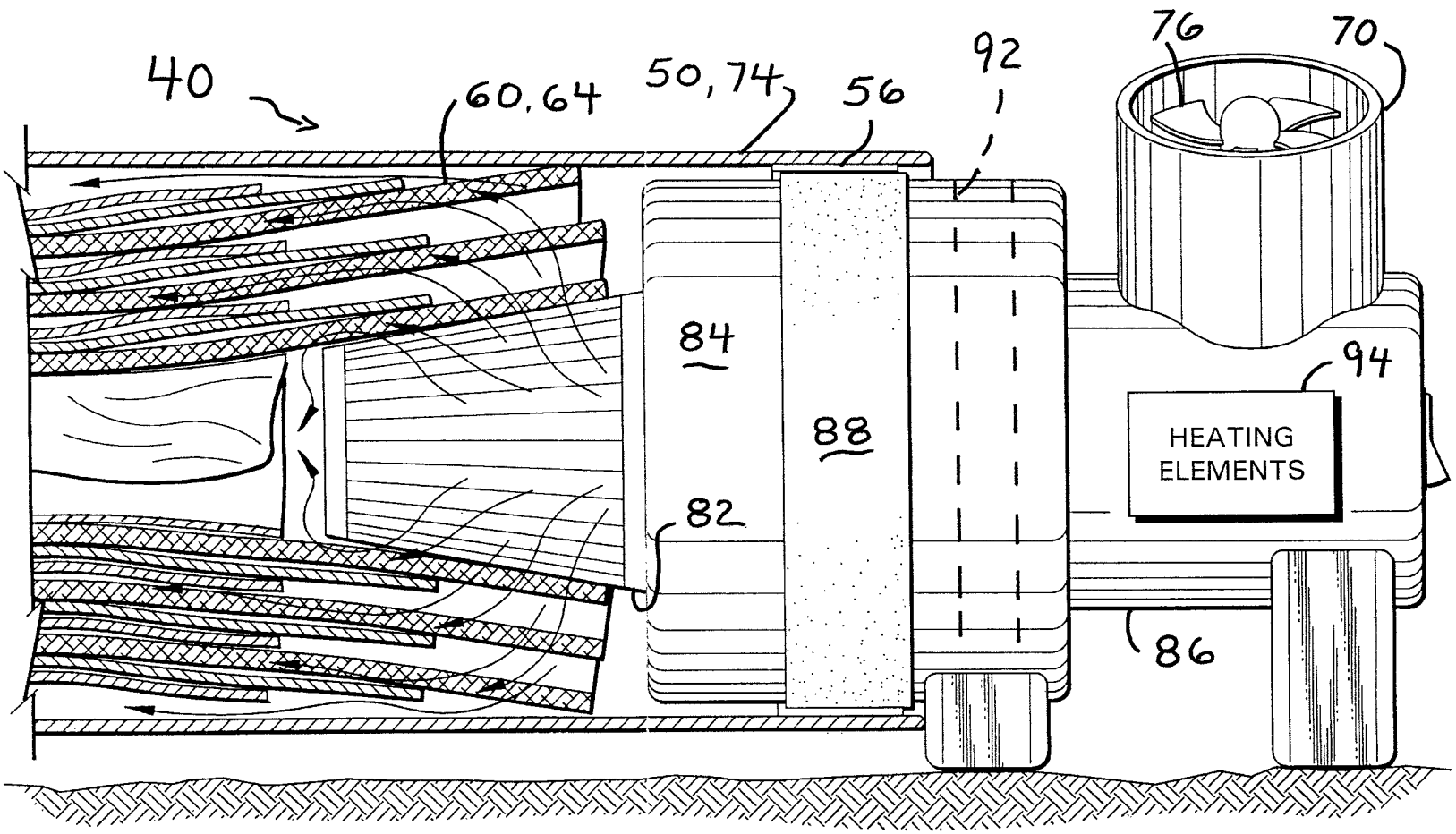
FIG. 14 is an enlarged scale section view taken through cutting line XIV-XIV in FIG. 10.

FIG. 14 shows better the construction of the air blowing plug 70. Like the ventilating plug 68, the air blowing plug 70 comprises a conic grill 82, a large-diameter pipe section 84, a medium-diameter pipe section 86, and a hook or pile ring 88.

As FIG. 14 shows, the large-diameter pipe section 84 serves in part as cylindrical collar to which is affixed the hook or pile ring 88. The hook or pile ring 88 serves to form a closure with the hook or pile strips 56 along the short edge of the rolled up tarp 66 that becomes the tubular sleeve 50. The conic grill 82 serves the purpose of being inserted part way into the core of the roll 64 of layered structure 60. For both the ventilation and air blowing plugs 68 and 70, the large-diameter pipe section 84 can be filled with desiccant provisions 30 (as secured between metal grill or chicken-wire disks/partitions inside the large-diameter pipe section 84, and indicated by dashed lines 92). The medium diameter pipe section 86 of the air blowing plug 70 has a closed end and has the air fan 76 mounted in a T-fashion into its sidewall. In contrast, the medium diameter pipe section of the ventilating plug 78 has no air fan nor a closed end. The end of medium diameter pipe section of the ventilating plug 68 is an open port and serves as a ventilation port 78.

Figure 13:
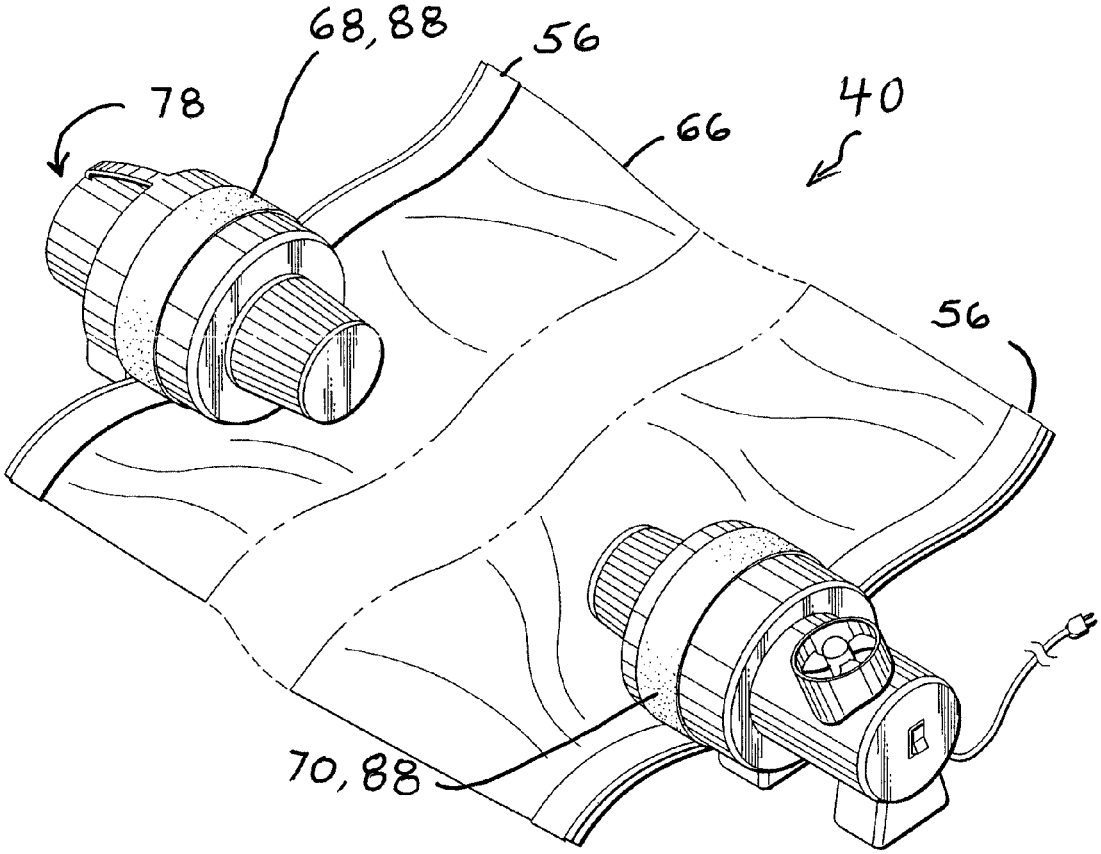
FIG. 13 is an enlarged scale perspective view comparable to FIG. 9, except with the coil removed from view and middle portions of the outer sleeve broken away.

The air blowing plug 70 has the electric powered air fan 76 configured to blow air into the tubular sleeve 50. That way, the air forced inside the tubular sleeve 50 tends to act to inflate the sleeve 50, rather than collapse the sleeve 50. Also, the air fan 76 blows moisture away such that a stream of moisture-laden air flows over the electric motor of the air fan 76. It would be preferable for some utilizations of the portable dryer 40 to have the air fan driven by a 12 VDC motor, with a cigarette lighter plug on the power cord. That way, camping gear could be dried on the camping trip by a motor vehicle, and without reliance on 120 VAC power. However, FIG. 13 shows that this air fan 76 is driven off 120 VAC.

It is also preferred to configure the air fan 76 to blow over its electric motor. That way, the air stream forced into the tube 50 can be moderately pre-heated by the fan 76's electric motor. Additional heating elements 94 can be installed inside either the medium diameter or large diameter pipe sections 86 or 84 of the air blowing plug 70 (which heating elements 94 are indicated schematically).

Given the foregoing, the reticulated foam panel 48 serves as an interspacer in the cylindrical coil 64 to make an elongated spiral passageway for the passage of forced air. The air blower 76 can either be rigged to blow forced air into the tubular sleeve 50 or else draw air through the tubular sleeve 50 in through the ventilation port 78. Preferably, the blower 76 blows air into the tubular sleeve 50, and therefore tending to inflate things. Preferably the tubular sleeve 50 is water resistant. That way, it be put to use outdoors in the rain (ie., so that the users can dry their damp gear in the very rain that made the gear damp).

It is an object of the invention that the tubular sleeve 50 with the cylindrical coil 64 therein can be arched into a C-shaped curve or the like. That way, the ten foot (~3 m) long tube 50 can be left inside a pick up truck bed and allowed to operate while left unattended during day or night. It is another object of the invention that the air blower 76 operates off 12 VDC both to allow it to be operated off a vehicle battery as well as for safety.

The ventilating air moving through the tubular sleeve 50 might be augmented by pre-heating it at the inlet end.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A compact portable dryer for damp outdoor gear, comprising:

a panel of a flexible continuous interspersed physical medium that serves as a spacer between layers of damp gear, and facilitates forced air ventilation therethrough, even serving as channels for liquid water to drain out of said damp gear, as well as allows gases and vapor to pass with little resistance also, being rolled into a tubular coil, rolling damp gear together with said panel of flexible continuous interspersed physical medium; and an air blowing plug coupled to one end of the tubular coil, whereby damp gear can be inserted inside the tubular coil for drying.

2. The compact portable dryer of claim 1, further comprising:

an outer sleeve comprising a rectangular and abbreviated panel of flexible material having closures arranged along one pair of spaced edges, wherein said closures along said one pair of spaced edges mate with each other in order to roll and secure the outer sleeve surrounding said tubular coil.

3. The compact portable dryer of claim 2, further comprising:

a ventilating plug coupled to the other end of said tubular coil.

4. The compact portable dryer of claim 1, wherein:

said panel of a flexible continuous interspersed physical medium that serves as a spacer between layers of damp gear, and facilitates forced air ventilation therethrough, even serving as channels for liquid water to drain out of said damp gear, as well as allows gases and vapor to pass with little resistance also, comprises foam;

said one pair of spaced edges corresponds to a leading edge for the tubular coil, and, a spaced away other edge respectively;

said foam panel is made of foam material of progressively denser density from the leading edge to the spaced away other edge, whereby an internal air flow forced, drawn or blown into the leading edge of the foam panel, said internal air flow through the panel will be relatively unimpeded at first proximate the leading edge except that the internal air flow will become progressively more impeded by the increasing density, thereby inducing progressively more of the internal air flow laterally out through the opposite broad sides of the panel.

5. The compact portable dryer of claim 4, wherein:

said one pair of spaced edges corresponds to a leading edge for the cylindrical tubular foam coil, and, a spaced away other edge respectively;

said foam panel comprises diagonal ribbons of flow partitions which, when said panel is rolled into a coil, said flow partitions are adapted such that an internal air flow forced, drawn or blown into the leading edge of the foam panel, said flow partitions will form spirals of flow barriers tending to force the internal air flow through the panel laterally out through the opposite broad sides of the panel.

6. The compact portable dryer of claim 1, wherein:

said panel further comprises infused desiccant material.

7. The compact portable dryer of claim 3, wherein:

said outer sleeve further comprises closures formed along another pair of spaced edges; and each plug comprises a ring of closures for mating with said closures on said other pair of spaced edges of the outer sleeve.

8. The compact portable dryer of claim 1, further comprising:

packets of desiccant rolled up together with said panel and damp gear and thereby being distributed throughout the tubular coil.

9. The compact portable dryer of claim 4, wherein:

said foam panel comprises density variations from the leading edge thereof to a spaced away other edge thereof, thereby inducing progressively more of the internal air flow laterally out through the opposite broad sides of the panel.

10. The compact portable dryer of claim 1, further comprising:

heating elements for pre-heating internal air flow and thereby forcing a heated internal air flow through the tubular coil.

11. The compact portable dryer of claim 1, wherein:

wherein said air blowing plug comprises a conic, side-venting nozzle for inserting into the core of the tubular coil.

12. A compact portable dryer for damp outdoor gear, comprising:

a panel of foam rolled into a tubular coil, rolling damp gear together with said panel of foam;

a ventilating plug for one end of the tubular coil; and an air blowing plug for the other end of the tubular coil, whereby damp gear can be inserted inside the tubular coil for drying.

13. The compact portable dryer of claim 12, further comprising:

an outer sleeve comprising a rectangular and abbreviated panel of flexible material having closures arranged along one pair of spaced edges, wherein said closures along said one pair of spaced edges mate with each other in order to roll and secure the outer sleeve surrounding said tubular coil;

said outer sleeve further comprises closures formed along another pair of spaced edges; and each plug comprises a ring of closures for mating with said closures on said other pair of spaced edges of the tubular outer sleeve.

14. The compact portable dryer of claim 13, wherein:

said closures comprise any of hook and/or pile strips, zippers, buttons or snaps.

15. A method of drying damp or wet outdoor gear, comprising the steps of:

rolling the damp or wet gear together with a panel of a flexible continuous interspersed physical medium that serves as a spacer between layers of damp gear, and facilitates forced air ventilation therethrough, even serving as channels for liquid water to drain out of said damp gear, as well as allows gases and vapor to pass with little resistance also, into a cylindrical roll;

securing the cylindrical roll in cylindrical form; and coupling an air blowing plug to one end of the cylindrical coil, whereby damp gear can be inserted inside the cylindrical coil for drying.

16. The method of claim 15, further comprising:

distributing desiccant throughout the cylindrical coil of the panel of flexible continuous interspersed physical medium and damp or wet gear.

17. The method of claim 15, further comprising:

coupling said one or the other end of the cylindrical coil with a ventilation plug; and forcing an internal air flow through the cylindrical roll to exhaust out the ventilation plug.

18. The method of claim 17, further comprising:

inserting the cylindrical coil the panel of flexible continuous interspersed physical medium and damp or wet gear into a generally cylindrical outer sleeve which extends between an inlet port and an exhaust port, whereby the internal air flow through the cylindrical coil is generally confined inside the outer sleeve between the inlet and exhaust ports.

19. The method of claim 17, further comprising:

powering the air-forcing source for forcing an internal air flow from the battery of a motor vehicle.

* * * * *